US005380963A

United States Patent [19]

Sadikin

[11] Patent Number: 5,380,963

[45] Date of Patent: Jan. 10, 1995

[54] ROTATING SPARK DISTRIBUTORS FOR A SPARK-FIRED INTERNAL COMBUSTION ENGINE

[76] Inventor: Lukas Sadikin, Jl. Kali Baru Barat No. 36, Jakarta Pusat, Indonesia

[21] Appl. No.: 111,331

[22] Filed: May 24, 1993

Related U.S. Application Data

[63] Continuation-in-part of Ser. No. 878,535, May 9, 1992, abandoned.

[30] Foreign Application Priority Data

May 26, 1992 [EP] European Pat. Off. ..... 9230472.8

[51] Int. Cl.[6] ..... H01H 19/00; H01H 1/00; F02P 1/00

[52] U.S. Cl. ..... 200/19 DR

[58] Field of Search ..... 200/19 R, 19 DR, 19 DC, 200/267, 268; 123/146.5 R, 146.5 A, 146.5 B

[56] References Cited

U.S. PATENT DOCUMENTS

| | | | |
|---|---|---|---|
| 3,947,729 | 3/1976 | Tesch | 361/119 |
| 3,949,721 | 4/1976 | Hori et al. | 200/19 R X |
| 4,007,342 | 2/1977 | Makino et al. | 200/19 R |
| 4,135,066 | 1/1979 | Yamanaka et al. | 200/19 R |
| 4,146,759 | 3/1979 | Watanabe et al. | 200/19 R |
| 4,373,124 | 2/1983 | Frame | 200/5 A X |
| 4,384,181 | 5/1983 | Booden | 200/61.76 |
| 4,475,491 | 10/1984 | Grunwald et al. | 123/146.5 A |
| 5,131,853 | 7/1992 | Meyer | 439/82 |

*Primary Examiner*—J. R. Scott

*Attorney, Agent, or Firm*—Jacobson, Price, Holman & Stern

[57] ABSTRACT

A rotor arm distributor is improved by adding a layer of tin or brass or an alloy of tin and brass on the conducting plate at the tip of a conventional rotor arm such that the "contact" area with the stationary metal contact in the distributor cover is increased and the electrical current conducted to the spark plug results in a stronger spark giving rise to improved combustion of fuel, increase in the power output of the engine, a fuel saving of between 5% to 10% and a reduction in air pollution.

3 Claims, 1 Drawing Sheet

ROTATING SPARK DISTRIBUTORS FOR A SPARK-FIRED INTERNAL COMBUSTION ENGINE

This application is a continuation-in-part application of U.S. application Ser. No. 07/878,535, filed May 9, 1992, now abandoned.

FIELD OF THE INVENTION

This invention relates to an improvement in a rotor arm of a distributor of a spark-fired internal combustion (IC) engine which is intended to increase the horsepower of the engine and at the same time to economize on the fuel consumption of the engine.

BACKGROUND OF THE INVENTION

A distributor rotor functions to distribute electrical current to spark plugs of an IC engine causing them to ignite fuel vapor in the cylinders of the engine and put the engine in motion. The rotor is usually made of a plastic core and a conducting plate (usually a brass plate) secured thereto. Generally, the thickness of the conducting plate is less than 1.7 millimeters and its design has changed little over many years.

The rotor arm rotates within a ring of stationary contacts (usually one for each cylinder of the engine) whereby current at high voltage fed to the axis of the rotor arm can spark across between the outer tip of the conducting plate and each stationary contact in turn as the rotor arm turns during operation of the engine.

With the widespread use of spark-fired IC engines in motor vehicles, any improvement in power output and/or fuel economy of the engine is widely sought. This invention promises improved performance of a spark-fired IC engine by means of a simple but unobvious modification of the distributor rotor by a cheap, readily-changeable spare part of such engines.

SUMMARY OF THE INVENTION

The invention concerns the provision of an increased edge area of the tip of the conducting plate of the rotor arm. Conveniently the edge of the tip includes a layer of tin or an alloy of tin and brass. By means of the invention, the area of the conducting plate available for current transmission, when the rotor arm revolves within the ring of stationary metal contacts in the distributor cap, is increased thus allowing a stronger electrical current to be conducted to the spark plugs. This additional layer may be about 1.5 millimeters thick.

A rotor arm improved in accordance with this invention has been found to produce a more powerful spark at the plug and thus better combustion and cleaner engine running with a consequent increase in engine horsepower, between 5% to 10% improvement in fuel combustion and reduced air pollution from the engine exhaust gases.

BRIEF DESCRIPTION OF THE DRAWINGS

The invention will now be further described, by way of example, with reference to the accompanying drawings, in which.

DETAILED DESCRIPTION OF THE PREFERRED EMBODIMENTS

Figure 1:
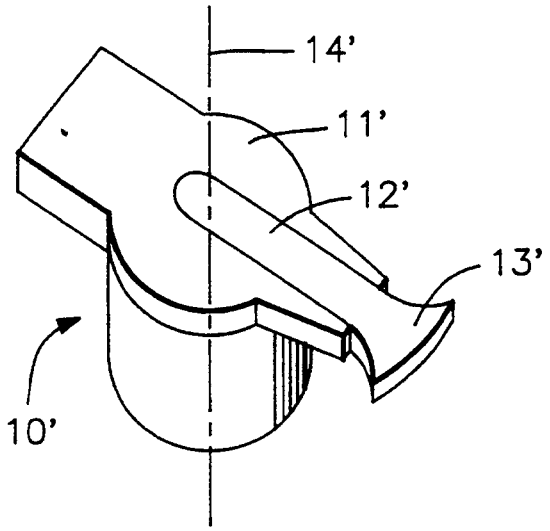
FIG. 1 (PRIOR ART)
FIG. 1 is a view of a conventional rotor arm.

The rotor arm 10' shown in FIG. 1 consists of an electrically-insulating core support 11' (e.g. of ebonite) carrying an electrically-conducting radial plate 12' (e.g. of brass) having a tip 13'. High voltage for firing each spark plug is led to the radially inner end of the plate 12' and passes through the plate to spark across from the tip 13' to a stationary contact (not shown) as each spark plug is energized in turn as the rotor arm 10' rotates about the axis 14'. The plate 12' would typically be of 1.5 millimeters thickness at the tip.

Figure 2:
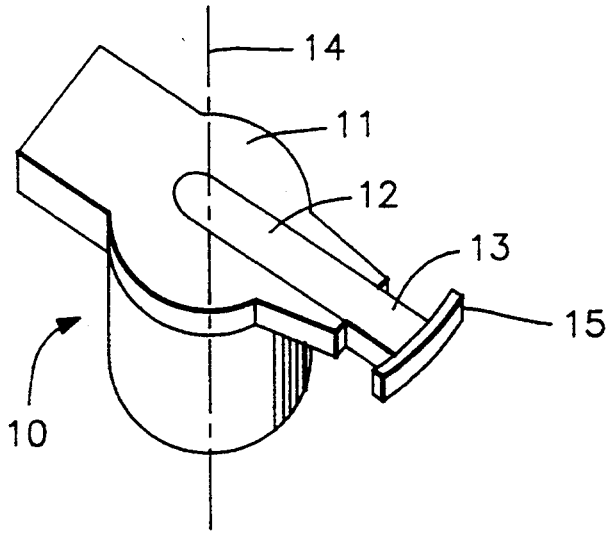
FIG. 2 is a view of a rotor arm in accordance with this invention.

The rotor arm 10 shown in FIG. 2 differs from that shown in FIG. 1 only by the provision of an extension 15 to the tip 13. The extension 15 is of tin or a tin/brass alloy which is at least as thick as the plate 12 at the tip 13 and has a radial extension of between 1 and 2 millimeters and has an extension in the circumferential direction of travel of the arm which substantially matches that of the tip 13. The ratio of tin to brass in the alloy can be about 50:50%.

In a modification, the extension 15 is of brass but has a thickness in the axial direction of the core support 11 between 1.75 millimeters and at least 3.0 millimeters.

I claim:

1. A rotor arm distributor for a spark-fired internal-combustion engine, said rotor arm comprising:

a core support, a conducting plate extending radially outwardly from said core support, said conducting plate having a predetermined thickness, and a free end tip of said conducting plate including a circumferential extension extending axially and integral therewith and having a thickness greater than said predetermined thickness, said extension being made of a combination of tin and brass so as to increase a contact area of said extension with a stationary metal contact to increase electrical current conducted to said stationary metal contact and eventually to a spark plug resulting in a stronger spark for improved combustion of fuel and increase in power output of an engine.

2. A rotor arm as claimed in claim 1, wherein the ratio of tin to brass in the free end tip is substantially 50% tin to 50% brass.

3. A rotor arm as claimed in claim 1, wherein a thickness at the free end tip is between 1.75 mm and at least 3 mm.

* * * * *

UNITED STATES PATENT AND TRADEMARK OFFICE

CERTIFICATE OF CORRECTION

PATENT NO. : 5,380,963

DATED : January 10, 1995

INVENTOR(S) : SADIKIN

It is certified that error appears in the above-indentified patent and that said Letters Patent is hereby corrected as shown below:

On the title page, left column at [30], please add --August 2, 1991 [ID] Indonesia .....P-000002--.

Signed and Sealed this

First Day of August, 1995

Bruce Lehman

*Attest:*

BRUCE LEHMAN

*Attesting Officer*

*Commissioner of Patents and Trademarks*